US006220182B1

(12) United States Patent
Duffy et al.

(10) Patent No.: US 6,220,182 B1
(45) Date of Patent: Apr. 24, 2001

(54) POSTAL WORKSTATION

(75) Inventors: Joseph T. Duffy, Torawanda, NY (US); Paul A. James, Hamilmo (CA)

(73) Assignee: Moore North America, Inc., Grand Island, NY (US)

( * ) Notice: Subject to any disclaimer, the term of this patent is extended or adjusted under 35 U.S.C. 154(b) by 0 days.

(21) Appl. No.: 09/302,223

(22) Filed: Apr. 29, 1999

(51) Int. Cl.[7] ..... A47B 37/00
(52) U.S. Cl. ..... 108/50.11; 108/50.01
(58) Field of Search ..... 108/50.01, 50.02, 108/50.11, 90, 182, 92, 93, 143; 312/223.3, 195, 196, 281, 282, 313

(56) References Cited

U.S. PATENT DOCUMENTS

| | | | | |
|---|---|---|---|---|
| 744,888 | * | 11/1903 | Widman | 312/282 |
| 846,319 | * | 3/1907 | Knapp | 312/282 X |
| 1,270,496 | | 6/1918 | Cimaglia . | |
| 2,556,943 | | 6/1951 | Reisman . | |
| 2,673,776 | | 3/1954 | Barnhart . | |
| 4,237,796 | | 12/1980 | Gordon et al. . | |
| 4,852,500 | * | 8/1989 | Ryburg et al. | 108/50.02 X |
| 5,568,773 | * | 10/1996 | Hung | 108/50.02 |
| 5,957,059 | * | 9/1999 | Burhman | 312/223.3 X |
| 6,012,788 | * | 1/2000 | Marschand et al. | 312/223.3 |
| 6,076,473 | * | 6/2000 | Conte | 108/50.01 |

FOREIGN PATENT DOCUMENTS

| | | | | |
|---|---|---|---|---|
| 225380 | | 1/1963 | (AT) . | |
| 4100675 | * | 7/1992 | (DE) | 312/223.3 |
| 0268802 | | 6/1988 | (EP) . | |
| 000531794 | | 3/1993 | (EP) . | |
| 2637475 | | 4/1990 | (FR) . | |

* cited by examiner

*Primary Examiner*—Jose V. Chen
(74) *Attorney, Agent, or Firm*—Simpson Simpson & Snyder LLP

(57) ABSTRACT

A postal workstation for high volume computerized printing of labels, cards, an the like comprises a main support surface including a front portion and a rear portion, wherein the front portion includes an open cut-out region for a person to stand within to comfortably reach the rear portion, which is intended to support primary and secondary printers and a monitor mount. A worksurface pivotally connected to the support surface adjacent a lateral side of the cut-out region is movable between a working position wherein the worksurface covers the cut-out region and provides area for a keyboard and mouse, and a servicing position wherein said cut-out region is exposed for facilitating worcer access to the rear portion of the main support surface for printer maintenance. A storage compartment adjacent an opposite lateral side of the cut-out region has an upwardly facing compartment opening covered by the worksurface when the worksurface is in a working position. The workstation further comprises an auxiliary support surface slidably mounted on the main support surface for travel along a path extending between the rear and front portions of the main support surface so that a secondary printer supported thereby can be easily accessed. A tray is supported for movement between a working position above the path of the auxiliary support surface, where it receives output from the secondary printer, and a servicing position removed from above the path of the auxiliary support surface so as not to block forward positioning of the secondary printer.

10 Claims, 4 Drawing Sheets

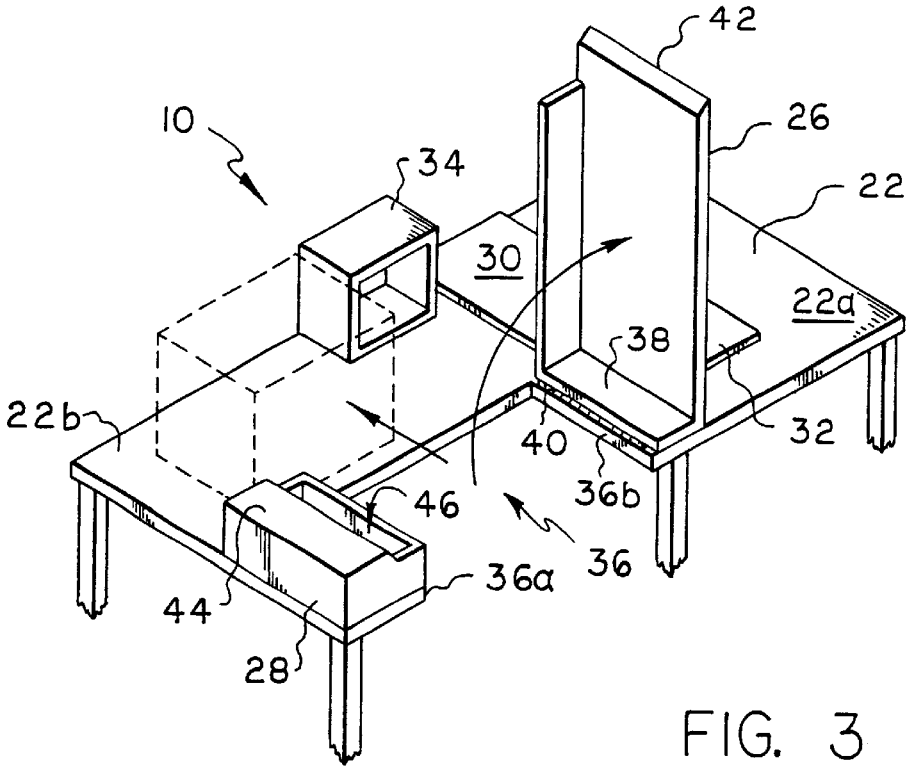
FIG. 3
FIG. 4
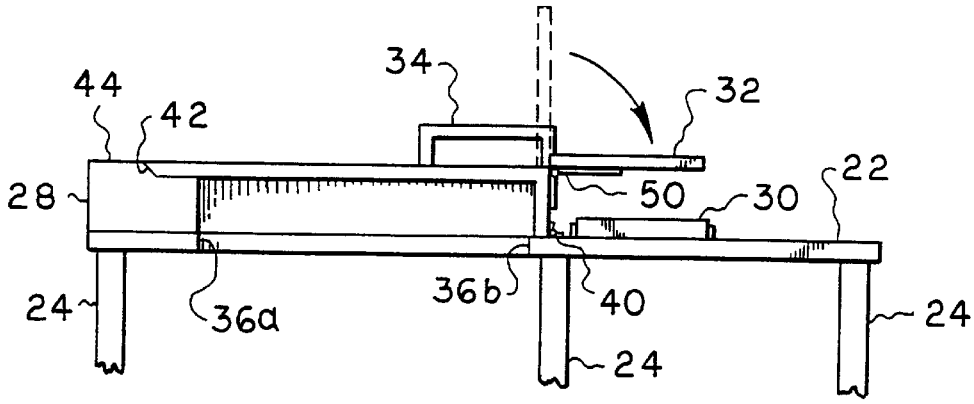

FIG. 5
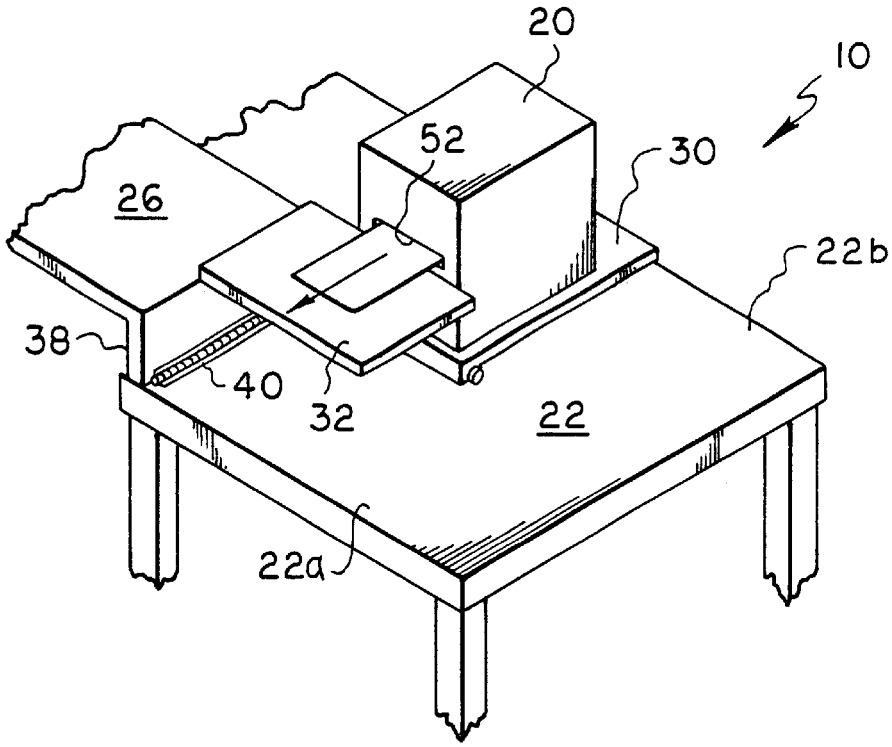
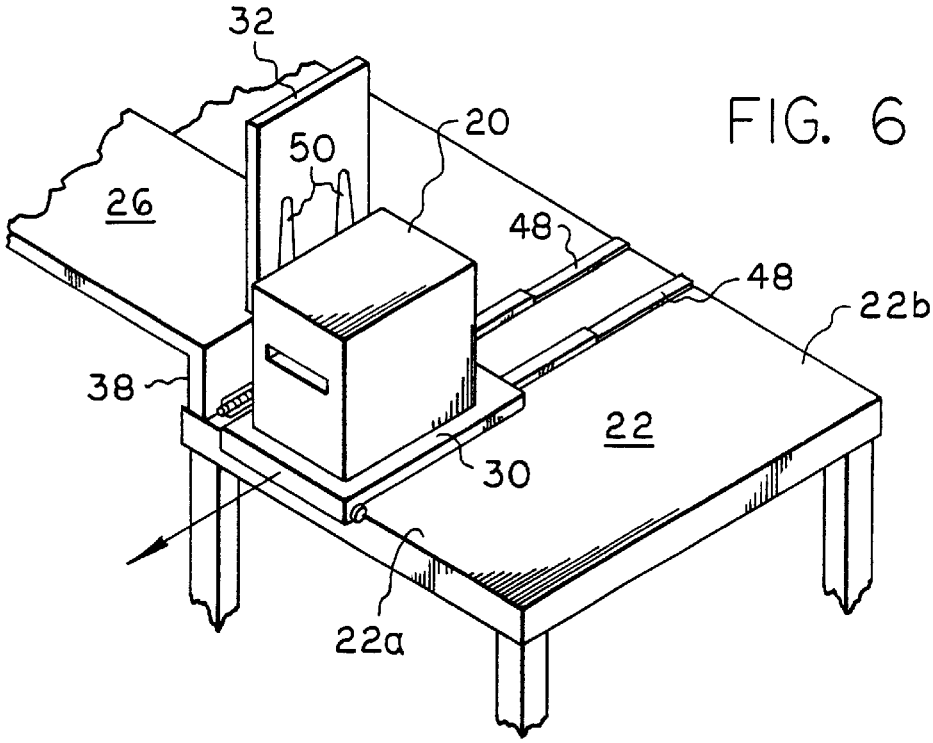
FIG. 6

POSTAL WORKSTATION

BACKGROUND OF THE INVENTION

A. Field of the Invention

The present invention relates to computerized workstations for printing labels, forms, and the like, and more particularly to a novel workstation suited for use and service of dual printers supported thereby.

B. Description of the Prior Art

Heretofore, computerized postal workstations for printing labels, forms, cards, and the like have generally comprised a large table having sufficient surface area to support a computer monitor, keyboard, mouse, and at least one attached printer while leaving space for collecting, sorting, and/or processing the printed output. It is commonplace in workstations of this type to find thermal printers dedicated to high volume use, and consequently it is necessary to restock such printers with labels, cards, etc., and to change printing ribbons or cartridges on a regular basis. In workstations comprising a large table-top, access to a primary and/or a secondary printer is often restricted, particularly if the printer is located at a rear portion of the table and the rear portion of the table abuts against a wall, and disruption of workstation operation becomes necessary to perform printer maintenance tasks.

SUMMARY OF THE INVENTION

Accordingly, it is an object of the present invention to provide a workstation for high volume computerized printing and processing operations that offers ergonomic placement of computer components, as well as convenient location of both a primary and a secondary printer for receiving and processing output therefrom. It is a related object of the present invention to provide such a workstation wherein the primary and secondary printers are each readily accessible for changing ribbons, sheet stock, card stock, labels, etc., and for performing service and repair.

A workstation formed in accordance with a first embodiment of the present invention includes a main support surface elevated by a plurality of legs. The main support surface includes a rear portion and a front portion having an open cut-out region sized to receive a person, for example an operator or service technician, to bring the rear portion of the main support surface within the comfortable reach of such person. A worksurface is pivotally connected to the front portion of the main support surface by a hinge and normally resides in a horizontal working position to close the open cut-out region and simultaneously close an upwardly facing compartment opening of a storage compartment located adjacent to the cut-out region. The rear portion of the main support surface is intended to support a primary printer, a monitor mount, and a secondary printer, while the worksurface provides an area for a keyboard and mouse. The worksurface pivots from its working position to a vertical servicing position to enable an operator or service technician to occupy the exposed cut-out region to facilitate access to the primary printer as needed. The secondary printer is situated atop an auxiliary support surface slidably mounted on the main support surface for movement between the rear and front portions of the main support surface, and a tray for receiving output from the secondary printer normally extends laterally from the worksurface to reside above a forward portion of the travel path of the auxiliary support surface. The tray is pivotally connected to the worksurface to allow it to be removed from above the travel path so that the auxiliary support surface and secondary printer can be slid forward to the front portion of the main support surface as needed.

In a second embodiment of the present invention, the lateral positions of the storage compartment and worksurface hinge are interchanged, and the tray is pivotally connected to the storage compartment.

BRIEF DESCRIPTION OF THE DRAWINGS

The nature and mode of operation of the present invention will now be more fully described in the following detailed description of the preferred embodiments taken with the accompanying drawing figures, in which:

FIG. 3 is a view similar to that of FIG. 1, however showing a worksurface of the workstation in a servicing position;

FIG. 4 is a front elevational view of the workstation shown in FIG. 1, showing adjustment of a tray of the workstation;

FIG. 5 is a partial top right perspective view showing use of the tray of the workstation when the tray is in a working position;

FIG. 6 is a view similar to that of FIG. 5, however illustrating forward positioning of a secondary printer by way of a slidable auxiliary support surface of the workstation with the tray in a servicing position.

DETAILED DESCRIPTION OF THE PREFERRED EMBODIMENTS

Figure 1:
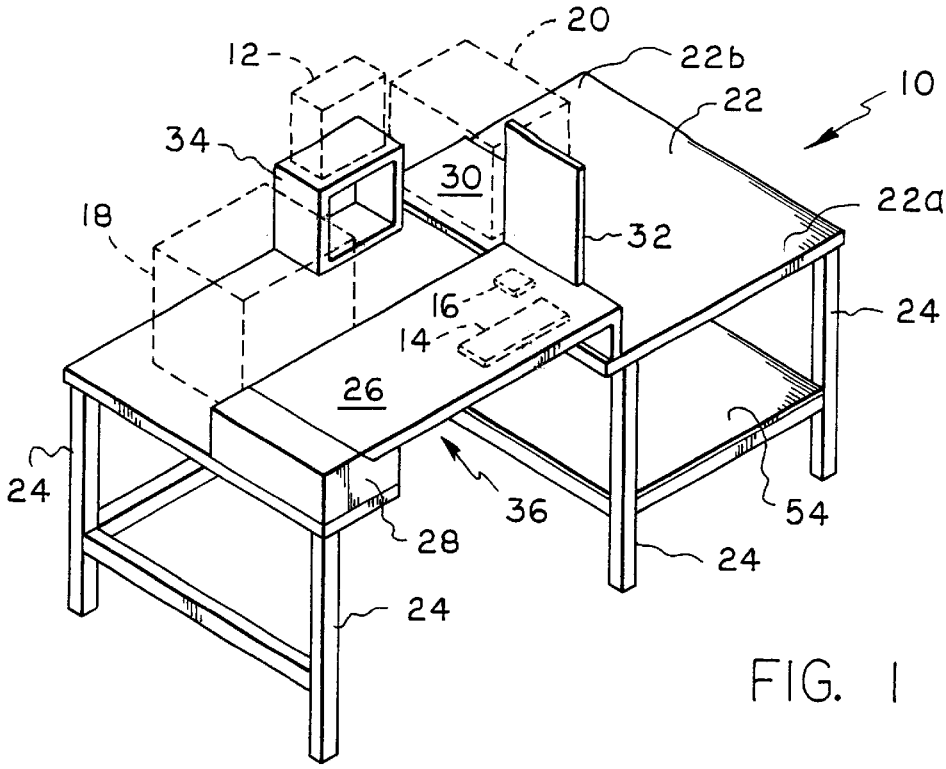
FIG. 1 is a top left perspective view of a workstation formed in accordance with a first embodiment of the present invention.
Figure 2:
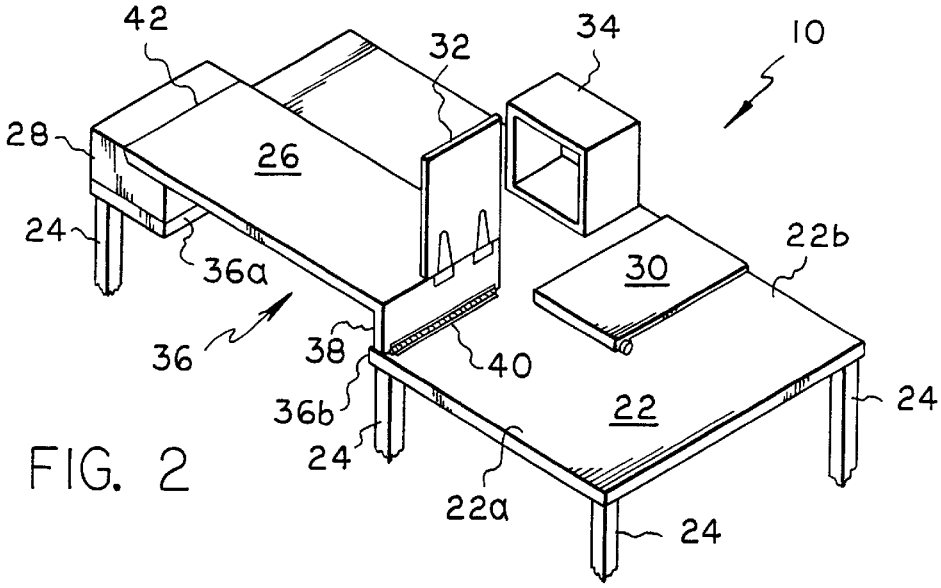
FIG. 2 is a top right perspective view of the workstation shown in FIG. 1.

Referring initially to FIGS. 1 and 2 of the drawings, a workstation formed in accordance with a first embodiment of the present invention is shown and identified generally by the reference numeral 10. Workstation 10 is intended for use in an environment requiring computerized printing of labels, forms, and the like, and processing of these items in high volume. For example, workstation 10 is suitable for use in a postal facility or business mailroom. By way of illustration, workstation 10 supports a computer monitor 12, a keyboard 14, a mouse 16, a primary thermal printer 18, and a secondary thermal printer 20, all of which are connected to a computer (not shown) in well-known fashion.

Workstation 10 generally comprises a main support surface 22 elevated from the floor by a plurality of legs 24, a worksurface 26, a storage compartment 28, an auxiliary support surface 30, a tray 32, and a monitor mount 34. Main support surface 22 includes a front portion 22*a* and a rear portion 22*b*, with front portion 22*a* being closer to an operator than rear portion 22*b*. As shown in FIG. 1, primary printer 18, monitor mount 34, monitor 12, auxiliary support surface 30, and secondary printer 20 are normally located on rear portion 22*b*.

Referring also now to FIG. 3, it can be seen that main support surface 22, and more specifically front portion 22*a* thereof, includes an open cut-out region 36 with spaced lateral sides 36*a* and 36*b* sized for an operator or service technician to stand within the cut-out region to facilitate access to equipment on rear portion 22*b*. Cut-out region 36 enables the operator or service technician to stand close to primary printer 18 for loading a printer ribbon and/or labels, and for performing maintenance and repair service. Primary printer 18 may be orientated such that its output is collected on rear portion 22*b* for further processing.

Worksurface 26 includes a right-angle side member 38 pivotally connected to main support surface 22 adjacent lateral side 36*b* of cut-out region 36 by a hinge 40 having a pivot axis that extends in a front to rear direction relative to main support surface 22. During normal printing operation at workstation 10, worksurface 26 is moved to a horizontal working position as shown in FIGS. 1 and 2 such that it covers cut-out region 36 and provides an area to place computer input devices including keyboard 14 and mouse 16. Side member 38 serves to elevate worksurface 26 relative to main support surface 22 for ergonomic reasons. A free side 42 of worksurface 26 opposite side member 38 is supported by storage compartment 28, as will be described further below, when worksurface 26 is in a horizontal working position. If access to primary printer 18 is desired, items on top of worksurface 26 may be removed and free side 42 lifted upwardly to pivot worksurface 26 to an upright servicing position to open cut-out region 36. As will be appreciated from FIG. 3, side member 38 provides a stable base for worksurface 26 when worksurface 26 is in an upright servicing position.

Storage compartment 28 is located adjacent the first lateral side 36*a* of cut-out region 36 and is preferably in the form of a rectangular box having a partial lid 44 defining an upwardly facing compartment opening 46. Free side 42 of worksurface 26 sits immediately adjacent to partial lid 44 when worksurface 26 is in a horizontal working position, such that compartment opening 46 is closed by an overlapping portion of worksurface 26. Storage compartment 28 can be used to store replacement ribbons, cartridges and labels for printers 18 and 20, as well as service tools and maintenance instructions for the printers.

Auxiliary support surface 30 is provided to support secondary printer 20 for use when primary printer 18 is out of order or otherwise unavailable, and is slidably mounted on main support surface 22 by way of telescoping or retracting parallel tracks 48 connected to main support surface 22 and the underside of auxiliary support surface 30, as can be seen in FIG. 6. Tracks 48 define a travel path between rear portion 22*b* and front portion 22*a* of main support surface 22, whereby secondary printer 20 can be moved forward from rear portion 22*b* to front portion 22*a* to permit servicing and regular maintenance of secondary printer 20.

Attention is presently directed to FIGS. 4–6, which depict tray 32 as being pivotally connected to worksurface 26 near side member 38 by hinged cantilever support brackets 50. Tray 32 normally rests in a horizontal working position such that it extends laterally from worksurface 26 to reside above a forward portion of tracks 48. As will be understood by reference to FIG. 5, auxiliary support surface 30 and secondary printer 20 carried thereby are positioned at a rearward portion of tracks 48 when secondary printer 20 is in use, and tray 32 rests in a working position adjacent an output feeder 52 of the secondary printer to collect output from the secondary printer. If access to secondary printer 20 by the operator or a service technician becomes necessary, tray 32 may be swung upward to a servicing position wherein it is removed from above tracks 48, as shown in FIG. 6, and secondary printer can be slid forward on auxiliary support surface 30. Tray 32 could also be mounted for laterally directed sliding motion into and out of a slot in worksurface 26 to accomplish selectable positioning of the tray above tracks 48.

Monitor mount 34 is supported by rear portion 22*b* of main support surface 22 and is chosen to provide mounting capability for an ergonomic viewing adjustment mechanism, such as a retractable monitor stand or the like. Monitor mount 34 is situated between primary printer 18 and secondary printer 20, and elevates a monitor sufficiently relative to main support surface 22 to give the operator an unimpeded line of sight over worksurface 26

Referring once again to FIG. 1, workstation 10 preferably includes shelving 54 under main support surface 22 for storing the computer housing, supplies and other items used at the workstation.

Figure 7:
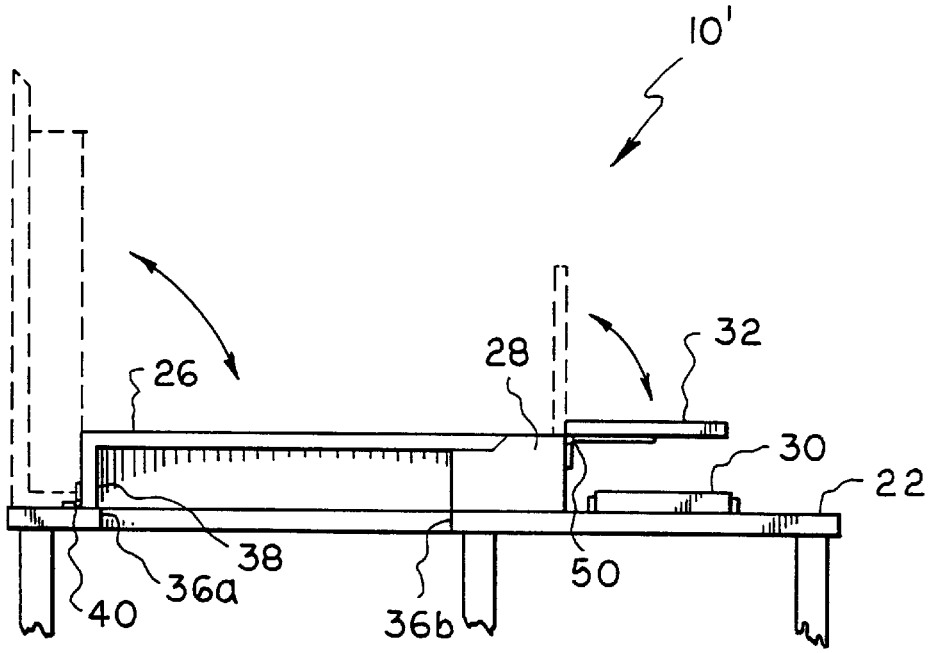
FIG. 7 is a front elevational view of a workstation formed in accordance with a second embodiment of the present invention.

FIG. 7 shows a workstation 10' formed in accordance with a second embodiment of the present invention. Workstation 10' is similar to workstation 10 of the first embodiment, however storage compartment 28 is located proximate to lateral side 36*b* of cut-out region 36 and supports tray 32, while side member 38 and the hinged connection of worksurface 26 to main support surface 22 are located adjacent lateral side 36*a* of cut-out region 36. Accordingly, worksurface 26 pivots counter-clockwise as viewed in FIG. 7 to move from a working position to a servicing position. This embodiment has the advantage of allowing tray 32 to remain in a horizontal working position while worksurface 26 is in a generally upright servicing position.

It will be understood from the foregoing description that an operator using a workstation according to the present invention can sustain productivity even when a primary printer 18 or secondary printer 20 is not operational. Moreover, a workstation of the present invention allows maintenance or repair of one printer while the other printer is in use. For instance, if primary printer 18 is not operational, a printing command can be redirected to secondary printer 20, any input devices can be temporarily removed from worksurface 26, and worksurface 26 can be pivoted to an upright servicing position to open storage compartment 28 and simultaneously expose cut-out region 36 for facilitating access to the primary printer. By way of further example, if secondary printer 20 is in need of maintenance or repair, tray 32 can be pivoted to an upright servicing position and secondary printer 20 moved forward along tracks 48 for easy access thereto.

What is claimed is:

1. A workstation comprising:

a main support surface including a front portion and a rear portion, said front portion having an open cut-out region;

a worksurface pivotally connected to said support surface adjacent said cut-out region, said worksurface being pivotal about a horizontal pivot axis extending front to rear of said main support surface for movement between a working position wherein said worksurface substantially covers said cut-out region and a servicing position wherein said cut-out region is exposed for facilitating worcer access to said rear portion of said main support surface; and a monitor mount positioned on said rear portion of said main support surface.

2. A workstation according to claim 1, wherein said worksurface is elevated relative to said main support surface when said worksurface is in said working position.

3. A workstation according to claim 1, further comprising a storage compartment on said front portion of said main support surface, said storage compartment having an upwardly facing compartment opening.

4. A workstation according to claim 3, wherein said worksurface covers said compartment opening when said worksurface is in said working position.

5. A workstation comprising:

a main support surface including a front portion and a rear portion, said front portion having an open cut-out region;

a worksurface pivotally connected to said support surface adjacent said cut-out region, said worksurface being movable between a working position wherein said worksurface substantially covers said cut-out region and a servicing position wherein said cut-out region is exposed for facilitating worcer access to said rear portion of said main support surface;

a monitor mount positioned on said rear portion of said main support surface; and an auxiliary support surface slidably mounted on said main support surface for travel along a path extending between said rear portion and said front portion of said main support surface.

6. A workstation according to claim 5, further comprising a tray adjustably connected to said worksurface, said tray being movable between a working position wherein said tray is substantially horizontal and resides above said path of said auxiliary support surface and a servicing position wherein said tray is removed from residing above said path.

7. A workstation according to claim 5, further comprising a tray adjustably connected to said storage compartment, said tray being movable between a working position wherein said tray is substantially horizontal and resides above said path of said auxiliary support surface and a servicing position wherein said tray is removed from residing above said path.

8. A workstation comprising:

a main support surface including a front portion and a rear portion, said front portion including an open cut-out region having first and second lateral sides;

a worksurface pivotally connected to said support surface adjacent one of said first and second lateral sides for rotation about a pivot axis extending front to rear of said main support surface, said worksurface being movable between a working position wherein said worksurface substantially covers said cut-out region and is elevated relative to said main support surface, and a servicing position wherein said cut-out region is exposed for facilitating worker access to said rear portion of said main support surface;

a storage compartment adjacent another of said first and second lateral sides, said storage compartment having an upwardly facing compartment opening covered by said worksurface when said worksurface is in said working position;

an auxiliary support surface slidably mounted on said main support surface for travel along a path extending between said rear portion and said front portion of said main support surface;

a tray supported for movement between a working position wherein said tray is substantially horizontal and resides above said path of said auxiliary support surface and a servicing position wherein said tray is removed from residing above said path; and a monitor mount positioned on said rear portion of said main support surface.

9. A workstation according to claim 8, wherein said path runs proximate to said one of said first and second lateral sides, and said tray is pivotally connected to said worksurface.

10. A workstation according to claim 8, wherein said path runs proximate to said another of said first and second lateral sides, and said tray is pivotally connected to said storage compartment.

* * * * *